United States Patent [19]

Endo et al.

[11] 4,085,034

[45] Apr. 18, 1978

[54] METHOD FOR THE THERMAL CRACKING OF HEAVY HYDROCARBON

[75] Inventors: Tomizo Endo; Yutaka Sumida; Toru Kawahara; Masaichi Ohtake; Shoichi Motokawa; Keiji Nagayama; Masatomo Shigeta; Hiroshi Hozuma; Masaharu Tomizawa; Hideo Kikuchi, all of Iwaki, Japan

[73] Assignees: Kureha Kagaku Kogyo Kabushiki Kaisha, Tokyo; Chiyoda Chemical Engineering & Construction Co., Ltd., Yokohama, both of Japan

[21] Appl. No.: 732,301

[22] Filed: Oct. 14, 1976

[30] Foreign Application Priority Data

Oct. 14, 1975 Japan ..... 50-122855
Oct. 14, 1975 Japan ..... 50-122857

[51] Int. Cl.[2] ..... C10G 9/16; C10G 9/18

[52] U.S. Cl. ..... 208/48 R; 23/284; 208/40; 208/106; 208/130

[58] Field of Search ..... 208/48 R, 48 Q, 106, 208/130, 40

[56] References Cited

U.S. PATENT DOCUMENTS

| | | | |
|---|---|---|---|
| 3,015,619 | 1/1962 | Wimmer et al. | 208/48 R |
| 3,498,753 | 3/1970 | Hokari et al. | 208/130 |
| 3,593,968 | 7/1971 | Geddes | 208/48 Q |
| 3,674,679 | 7/1972 | Washimi et al. | 208/48 R |

*Primary Examiner*—Herbert Levine
*Attorney, Agent, or Firm*—Lane, Aitken, Dunner & Ziems

[57] ABSTRACT

In a process for the thermal cracking of a heavy hydrocarbon in a cylindrical reactor, a portion of the content material in the reactor is taken out and injected back into the reactor according to a specific procedure to form a "wet wall" or liquid curtain on the inner peripheral wall of the reactor, thereby preventing coking in the reactor.

3 Claims, 5 Drawing Figures

METHOD FOR THE THERMAL CRACKING OF HEAVY HYDROCARBON

FIELD OF THE INVENTION

This invention relates to a method for the thermal cracking of a heavy hydrocarbon in a reactor while substantially preventing coking therein.

BACKGROUND OF THE INVENTION

The most serious problem encountered in the thermal cracking, in a reactor, of a heavy hydrocarbon such as asphalt, coal tar, heavy oil, crude oil, etc., is how to prevent coking from taking place on the interior wall surface of the reactor. Such coking or coke deposition is rather limited in the case of light hydrocarbons such as gaseous hydrocarbons, naphtha, etc., but a stronger tendency toward coking is seen when the hydrocarbon material to be thermally cracked is of the heavy type such as above-mentioned. Therefore, in practicing an industrial cracking of the heavy hydrocarbon, prevention of such coking is a major factor for successful operation of the reactor.

As a measure against such coking and coke deposition, there has been proposed a so-called "wet wall" forming method which is generally employed in the thermal cracking of naphtha. According to this method, a light oil is allowed to flow down into the reactor along its internal wall after the mode of an overflow unit, or a light oil is similarly allowed to flow down from a slit or slits provided at the top of the reactor, so as to form a so-called liquid curtain over the internal wall surface of the reactor. This method, however, has a disadvantage that the reaction product (pitch) might be diluted by the light oil, thereby forming a slurry, in the course of thermal cracking of the heavy hydrocarbon. Even if a portion of the bottom material produced in the course of cracking reaction of the heavy hydrocarbon material in the reactor is taken out of the reactor and the portion of the bottom material is used in place of the light oil for avoiding dilution of the reaction product (pitch), coking can still take place in the sump when the sump is provided at the top. When a slit or slits are provided at the top of the reactor, such slit or slits might be closed by coking, hindering the smooth continuous operation of the reactor.

SUMMARY OF THE INVENTION

The object of this invention, therefore, is to provide an advantageous method for the thermal cracking of the heavy hydrocarbon, which method is capable of effectively inhibiting coking in the reactor and hence eliminating the problems of the prior art.

This and other objects and features of this invention will become more apparent from reading the following detailed description of the invention.

In order to establish a reliable method for coking-free thermal cracking of the heavy hydrocarbon, extensive studies have been pursued for many years on the phenomenon of coking in the reactors and, as a result, it has been discovered that the heavy hydrocarbon can be thermally cracked without causing coking and in a very satisfactory manner when a portion of the reactor contents is removed during the thermal cracking operation and injected back into the reactor according to a specific procedure described below so as to form a "wet wall" in the reactor.

According to the present invention, in the thermal cracking of a heavy hydrocarbon in a cylindrical reactor for converting the heavy hydrocarbon into pitch and an oil fraction, there is provided a method for coking-free thermal cracking of the heavy hydrocarbon. The method includes removing a portion of the reactor contents and then injecting the material thus taken out back into the reactor in a direction tangential to the peripheral wall of the reactor from two or more spots in the peripheral wall in an upper part of the reactor, so as to form a wet wall or liquid curtain over the inner peripheral wall surface of the reactor.

DETAILED DESCRIPTION OF THE INVENTION

According to the principle of this invention which is applied to the thermal cracking of heavy hydrocarbon in a cylindrical reactor, a portion of the reactor content is taken out of the reactor and such portion of material is used to form a wet wall or liquid curtain over the entire inner peripheral wall of the reactor, thereby inhibiting coking in the reactor. The "content material" referred to above is the reactant material within the cylindrical reactor, and more specifically, it is the "bottom" material under reaction. A portion of such material is taken out from the bottom of the cylindrical reactor, and the removed material is used for forming a wet wall over the interior of the cylindrical reactor. According to the present invention, the wet wall can be formed by injecting the material into the reactor in a direction tangential to the peripheral wall of the reactor from plural (two or more) spots in upper peripheral wall of the reactor. The injection of the material is accomplished by means of nozzles provided at plural locations on the upper peripheral wall of the reactor and oriented tangentially to the peripheral wall of the reactor. The wall wetting rate and the number of nozzles provided may differ depending on the properties of the heavy hydrocarbon, the thermal cracking reaction conditions and size of the cylindrical reactor used, but usually it is preferable that the wall wetting rate is 5 to 20 $m^3$/hour per 1 m of the circumferential length of the cross section of the cylindrical reactor, while the nozzles are preferably provided at intervals of 50 cm to 2 m along the circumferential length of the cross section of the reactor. In setting the nozzles at the plural locations on the upper peripheral wall of the cylindrical reactor, it is preferable to provide a belt-shaped bulge circumferentially around the upper peripheral wall of the reactor and to set the nozzles at equidistantly spaced locations along the belt-shaped bulge. It is also preferable to dispose an annular tubing so as to surround the cylindrical reactor in a suitable position relative to the bulge and to introduce a heat transfer oil medium at a temperature of 250° to 350° C into the annular tubing.

The invention is now described in further detail with reference to the accompanying drawing.

Figure 1:
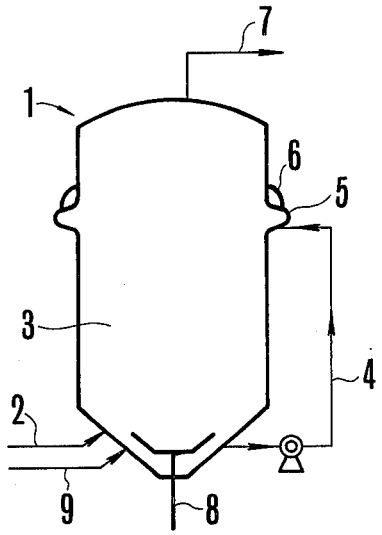
FIG. 1 is a schematic drawing illustrating an embodiment of cylindrical reactor system used in practicing the thermal cracking of the heavy hydrocarbon according to the method of this invention.

Referring first to FIG. 1, reference numeral 1 designates a cylindrical reactor, 2 a heavy hydrocarbon feed pipe, 3 the content material in the reactor 1, 4 a content material feed pipe, 5 a belt-shaped bulge provided circumferentially around the upper peripheral wall of the reactor 1, 6 an annular tubing disposed in a suitable position relative to the bulge 5, 7 a discharge pipe for releasing the gaseous material and oil fraction produced by the thermal cracking of the heavy hydrocarbon, 8 an agitator, and 9 a pipe for feeding a high-temperature heating gas medium for thermally cracking the heavy hydrocarbon.

According to the present invention, a heavy hydrocarbon such as asphalt, coal tar, heavy oil, crude oil, etc., is, after being preheated, introduced into the reactor 1 through the feed pipe 2 and heated therein to 400° to 430° C by a high-temperature heating medium gas such as superheated steam supplied from its feed pipe 9 and is thereby cracked. During this operation, a portion of the content material 3 in the reactor 1 is transferred into the belt-shaped bulge 5 through the feed pipe 4 and injected into the reactor 1 from the nozzles (not shown) provided in the bulge 5. As the circulating heat transfer oil medium in the annular hollow attachment 6 is maintained at a temperature of 250° to 350° C, the material 3 supplied into the belt-shaped bulge 5 is cooled by the oil medium, which proves helpful in inhibiting the occurence of coking in the bulge 5. The material 3 at 400° to 430° C is injected into the bulge 5 tangentially to its peripheral wall from the nozzles provided at the plural locations along the bulge 5. Owing to the centrifugal force, the injected material fills up a portion of the belt-shaped bulge 5 and flows down while forming an uniform circumferential wet wall or liquid film over the entire inner peripheral wall of the reactor. The temperature of the inner peripheral wall and the temperatue of the wet wall forming material are substantially equal to each other, so that even if the precursor of coke should deposit on the inner peripheral wall, it is washed down by the flowingdown liquid before it has any chance of getting coked. It is preferable that the injection rate of the material 3 is within the range of 5 to 20 $m^3$/hour per 1 m of the circumferential length of the cross-section of the reactor 1. If the injection rate is less than 5$m^3$/hour, wet wall washing force is not sufficient to provide the desired anticoking effect, while if such rate exceeds 20 $m^3$/hour, there is required a pump for transferring a large volume of material 3 under high temperature. This involves both economical and technical difficulties. It should be also noted that if the circulating heat transfer oil medium in the annular tubing 6 is too low, fluidity of the material 3 may be lowered in the vicinity of the cooling section, while too high a temperature of such oil medium may invite coking in the apparatus.

According to the present invention no clogging of the wall wetting device itself takes place by solid alien matter or coke, owing to the presence of the belt-shaped bulge 5 around the upper peripheral wall of the reactor 1. Also, as the belt-shaped bulge 5 is cooled by the annular belt of heat transfer medium circulating at a lower temperature in the annular tubing 6, any risk of coking in the belt-shaped bulge 5 is prefectly eliminated.

Figure 2:
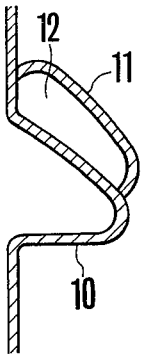
FIG. 2 is an enlarged sectional view showing a belt-shaped bulge provided circumferentially around the upper peripheral wall of the cylindrical reactor and an annular tubing provided surrounding the cylindrical reactor in contact with the upper external wall surface of the belt-shaped bulge.
Figure 3:
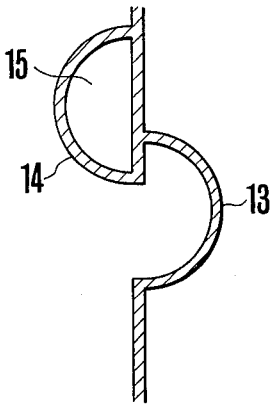
FIG. 3 is a similar view to FIG. 2 but showing another form of combination of the belt-shaped bulge and the annular tubing.
Figure 4:
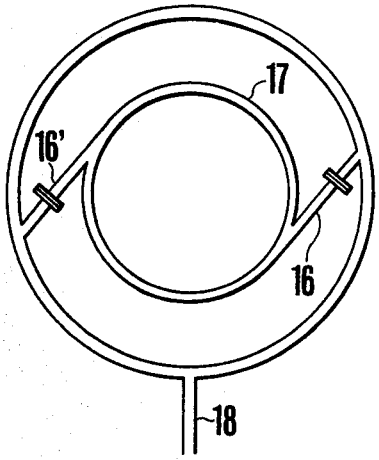
FIG. 4 is a schematic drawing showing a form of structural arrangement in the reactor where two nozzles are provided in the belt-shaped bulge shown in FIG. 2 or FIG. 3.
Figure 5:
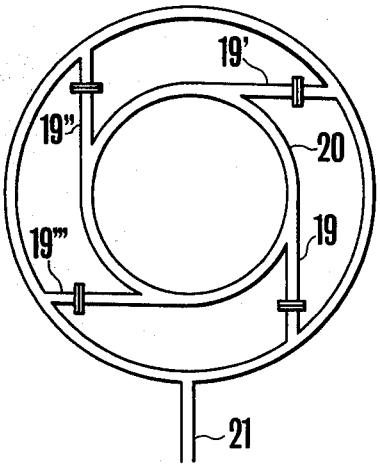
FIG. 5 is a similar view of FIG. 4 but showing another form of structural arrangement where four nozzles are provided in the belt-shaped bulge shown in FIG. 2 or FIG. 3.

The belt-shaped bulge 5 and annular tubing 6 may be arranged in various ways. FIG. 2 shows just an example thereof. The arrangement such as shown in FIG. 3 is also embraced within the scope of this invention. In FIG. 2, numeral 10 indicates a belt-shaped bulge (corresponding to 5 in FIG. 1), 11 an annular tubing (corresponding to 6 in FIG. 1), and 12 a space through which the heating oil medium is circulated. In FIG. 3, numeral 13 designates a belt-shaped bulge (corresponding to 5 in FIG. 1), 14 an annular tubing (corresponding to 6 in FIG. 1), and 15 a space through which the heat transfer oil medium flows. Nozzles are provided in the belt-shaped bulge 10 or 13 as shown in FIGS. 4 and 5. FIG. 4 shows a form of arrangement where two nozzles 16 and 16' are provided in the belt-shaped bulge 17 (corresponding to 5 in FIG. 1). The nozzles 16 and 16', connected to a transfer pipe 18 (corresponding to 4 in FIG. 1), are orientated tangentially to the bulge 17 (same as the nozzle orientation in the reactor 1 of FIG. 1). In the arrangement shown in FIG. 5, four nozzles 19 to 19''' are provided in the belt-shaped bulge 20 (corresponding to 5 in FIG. 1), and these nozzles 19 – 19''', connected to a transfer pipe 21 (corresponding to 4 in FIG. 1), are also orientated tangentially to the circumferential bulge 20.

As described above, it is thus possible with this invention to easily attain the object of preventing coking in the process for producing pitch and oil fraction from the heavy hydrocarbon such as asphalt, coal tar, heavy oil, crude oil, etc., through the thermal cracking thereof, so that employment of this invention allows continuous coking-free operation. The pitch obtained from the method of this invention, useful as a binder, when mixed with weak- or non-coking coal, provides strong-coking coal necessary for production of blast furnace coke. This greatly contributes to the solution of the problem of shortage of strong-coking coal. Also the by-product oil fraction can be easily refined by a commonly employed desulfurization system for use as various kinds of fuel oils or as compounding ingredients thereof.

Now, the present invention is described in further detail by way of several embodiments. These embodiments, however, are merely illustrative and not restrictive of the scope of the present invention.

EXAMPLE 1

A vacuum residue of Khafji crude oil preheated to 490° C was supplied into the bottom of a cylindrical reactor with inner diameter of 600 mm and height of 6 m at the rate of 300 kg/hour together with a superheated steam of 700° C at the rate of 100 kg/hour to thermally crack the vacuum residue at 420° C for the production of binder pitch and oil fraction. The liquid phase in the reactor was filled with a molten pitch, and this molten pitch, with its surface level controlled, was continuously removed from the bottom of the system. Oil fraction and steam were also continuously discharged from the top of the reactor. When no wet wall was formed in this apparatus, there was produced a 120 mm thick build-up of coke on the interior wall surface of the reactor after 200-hour operation, and the reactor was almost clogged. On the other hand, when two nozzles were provided at an upper part of the reactor and the molten pitch was recycled upwardly to the nozzles (without providing any direct sump) and injected into the reactor tangentially to form a wet wall in accordance with the present invention, there were obtained excellent results as shown in Table 1 below even after 200-hour operation.

Table 1

| Experiment No. | 1 | 2 |
|---|---|---|
| Wall wetting rate ($m^3$/hour . m) | 2.97 | 5.85 |
| Wet wall inlet temperature (° C) | 420 | 420 |
| Coke build-up (mm) | 48 | 6 |

The results from both Experiment Nos. 1 and 2 are far better than when no wet wall is formed. The slightly inferior result of Experiment No. 1 as compared with Experiment No. 2 indicates slight deficiency of the wall wetting rate.

EXAMPLE 2

A wet wall forming unit such as shown in FIG. 3 was provided in an upper portion of a cylindrical reactor as used in Example 1. This wet wall forming unit was in the form of a circumferential bulge constructed by winding a half-cut 2-inch pipe externally around the reactor while providing two ¾-inch nozzles tangentially to the circumferential bulge as shown in FIG. 4.

A vacuum residue of Iranian Heavy crude oil was subjected to the thermal cracking treatment by using this reactor to produce binder pitch and oil fraction. The results are shown in Table 2 below.

Table 2

| | | Comparative Examples | | This invention |
|---|---|---|---|---|
| Experiment No. | | 1 | 2 | 3 |
| Operating time (hour) | | 180 | 180 | 180 |
| Material | Charge (kg/hour) | 300 | 300 | 300 |
| | Charging temperature (° C) | 485 | 491 | 488 |
| Reactor temperature (° C) | | 414 | 415 | 415 |
| Steam | Flowrate (kg/hour) | 130 | 130 | 130 |
| | Temperature (° C) | 685 | 685 | 685 |
| Wet wall | Flowrate ($m^3$/hour) | 0 | 7.5 | 15 |
| forming | Wall wetting ($m^3$/hour . m) | 0 | 4.0 | 8.0 |
| material | Inlet temperature (° C) | — | 415 | 415 |
| Heat transfer oil medium temperature (° C) | | — | 290 | 295 |
| Coke build-up (mm) | | 125 | 60 | 5 |

As apparent from Table 2, use of the wet wall forming unit according to this invention can phenomenally decrease build-up of coke as compared with the case where no such unit is used. In Experiment No. 2 where the wall wetting was deficient, there was observed a substantial build-up of coke, but if the wet wall forming rate was sufficient, such coke build-up was extremely limited.

What is claimed is:

1. In a process for the thermal cracking of a heavy hydrocarbon in a cylindrical reactor by direct contact with a heating medium, the improvement comprising the steps of:
   (a) removing a portion of the reactor contents from a lower section of the reactor; and
   (b) injecting said portion into an annular recess provided around the circumference of the upper interior of the reactor in a direction tangential to the inner cylindrical wall of the reactor from a plurality of points on the wall, thereby filling the annular recess by centrifugal force and forming a liquid curtain over the cylindrical wall surface of the reactor below the injection point.

2. The method according to claim 1, wherein the injection rate of said portion is within the range of 5 to 20 $m^3$/hour per 1 m of the circumferential length of the cross-section of said reactor.

3. The process of claim 1 additionally comprising cooling said portion prior to injection into the reactor.

* * * * *